US005103878A

United States Patent [19]

Cassia

[11] Patent Number: 5,103,878

[45] Date of Patent: Apr. 14, 1992

[54] APPARTAUS AND METHOD FOR FLUSHING AND DRAINING THE COOLANT SYSTEM OF A VEHICLE

[76] Inventor: Roland A. Cassia, 12 Allan Dr., White Plains, N.Y. 10605

[21] Appl. No.: 575,041

[22] Filed: Aug. 29, 1990

[51] Int. Cl.[5] ..... B65B 3/04; B65B 3/12

[52] U.S. Cl. ..... 141/65; 220/DIG. 32; 141/7; 141/89; 141/92; 134/169 A

[58] Field of Search ..... 141/1, 7, 59, 65, 89-92; 220/DIG. 32; 134/169 A; 165/95; 123/41.14, 41.42

[56] References Cited

U.S. PATENT DOCUMENTS

| | | | |
|---|---|---|---|
| 2,029,232 | 1/1936 | Green | 165/95 X |
| 2,839,068 | 6/1958 | Cassia . | |
| 3,034,521 | 5/1962 | Greenfield | 165/95 X |
| 3,151,887 | 10/1964 | Barry et al. . | |
| 3,653,430 | 4/1972 | Kinast . | |
| 4,378,034 | 3/1983 | Albertson | 141/1 |
| 4,390,049 | 6/1983 | Albertson | 141/92 |
| 4,634,017 | 1/1987 | Kilayko . | |
| 4,911,211 | 3/1990 | Andersen | 141/7 |
| 4,949,765 | 8/1990 | Creeson | 141/7 |

*Primary Examiner*—Ernest G. Cusick
*Attorney, Agent, or Firm*—Lucas & Just

[57] ABSTRACT

A flush cap for a vehicle cooling system wherein the flush cap has an inlet through which fresh water enters and an outlet through which dirty coolant leaves. The method employs the flush cap to flush the cooling system of the vehicle. The radiator cap can be adapted to drain a radiator using a hose attached to the outlet of the cap.

7 Claims, 10 Drawing Sheets

APPARTAUS AND METHOD FOR FLUSHING AND DRAINING THE COOLANT SYSTEM OF A VEHICLE

This invention relates to an apparatus and method for continuous flushing of the cooling system of a vehicle without the need to open the drain cocks and for draining the cooling system.

Corrosion materials such as rust and solder corrosion residue are formed in the cooling systems of vehicles as the corrosion inhibitors in antifreeze break down from heat over time. These corrosion materials reduce cooling system efficiency. Additionally, the abrasive nature of the suspended corrosive materials increases the wear on the radiator, water pump, hoses, thermostat, and heater core. Malfunction of cooling system components is one of the most common cause of vehicle breakdowns on the highway.

Most vehicle manufacturers recommend changing the coolant every year. To properly change the coolant in a vehicle cooling system, it is necessary to flush and drain the radiator, the engine block, the heater core and the connecting hoses. Flushing and draining of only the radiator does not flush or drain the coolant from the engine block, heater and the connecting hoses, because the flow of coolant from the latter areas to the radiator is blocked by a thermostatically regulated valve which is closed unless the system is at operating temperature. Conventionally this valve is simply called the thermostat.

There are presently several different approaches an individual vehicle owner or a mechanic can follow to flush and drain old coolant from the entire cooling system. All have their drawbacks.

In one technique for continuous flushing of an engine's cooling system a garden hose-coupled "T" is installed in the heater hose. The hose is cut and the "T" installed between the cut ends. With the radiator drain cock open, the radiator cap off, and the engine running, to keep the thermostat open, water is continuously admitted through the "T" and circulated by the water pump. The water displaces old coolant which discharges through the radiator drain cock and the cap. After a sufficient period of time, drainage clarity indicates that old coolant and corrosion have been displaced by clean water.

For a person who is not a mechanic, utilizing this continuous flushing technique presents a number of problems including precise identification of the proper hose to cut and where to cut it, the requirement for a large volume of water to flush the cooling system, and the need to open the drain cocks.

Another continuous method for flushing a cooling system on a vehicle is taught in my U.S. Pat. No. 2,839,068 issued June 17, 1958. These methods are continuous because fresh water constantly flows into the cooling system while dirty coolant is constantly diluted and removed from the system while the engine is running and the thermostat is open. There are a number of batch-style methods employed for draining a vehicle's cooling system.

One batch-style method involves opening up the system at multiple points and flushing each individual component separately. The thermostat, heater hose and the lower engine-to-radiator hose are removed and the drain cocks on the engine and the radiator are opened. Water is flushed through the various individual components. However, a great deal of work is required in order to open up the system and to flush each component with water. In particular, opening the drain cock or removing the bottom hose frequently requires the operator to get under the car and to use a wrench on the drain cock handle, which is intended for hand turning but frequently is stuck tight by corrosion. Also, immediately upon opening the drain cock or hose, used coolant flows out, frequently resulting in both the operator and the ground being covered by the used coolant before it can be collected. This method is inconvenient and dangerous.

Another batch-style method of draining and flushing the entire cooling system involves repeatedly draining the radiator by opening up the drain cocks at the bottom of the radiator, closing the drain cocks and refilling the radiator with water, and running the engine to normal operating temperature. The thermostat is opened and coolant previously trapped in the engine block mixes with the clean water in the radiator. By repeating the steps, the amount of old coolant and corrosion remaining in the system is reduced by approximately one-half each time the radiator is emptied. This method requires a great deal of physical labor. The operator must get under the automobile several times to open and close the radiator drain cocks. Also if the car is jacked up, it must be let down each time in order to run the engine. Further, after the first engine warm-up to open the thermostat, the operator either has to open the draining point on a hot radiator or wait a period of time for the system to cool down before proceeding.

As is evident from the above description, in order to drain the cooling system, the drain cock must be opened. A method used to drain the coolant from a coolant system without the need to open the drain cock is to simply siphon the coolant from the radiator cap opening. See for example U.S. Pat. No. 4,911,211 issued Mar. 27, 1990. The disadvantages to this method and apparatus include the requirement for a control system to ensure that the proper valves are operated for the priming step, the requirement for a separate priming step which must be performed before the radiator can be drained, and the requirement for the waste container to be at an elevation lower than that of the radiator so that the coolant can be siphoned off.

Because of the limitations of the known methods for replacing used coolant, many car owners do not replace used coolant because of the attendant difficulty of the task. Therefore, a large number of vehicles are not serviced as they should be, leading to high costs of poorer performance and more frequent maintenance, shortened engine life, and more frequent highway break downs. Such costs could be reduced by providing a way for individual vehicle owners to properly flush their cooling systems and recharge them with fresh coolant, without the need for substantial mechanical expertise and physical labor.

The present invention provides a simple and low-cost apparatus and method suitable for flushing and draining the coolant from the coolant system of a vehicle. The method and apparatus of the present invention has been found to be suitable for use in both cross flow and down flow radiators.

The apparatus of the present invention comprises a flush cap which replaces the existing radiator cap of a vehicle for the flushing and draining steps. The flush cap of the present invention comprises a fresh water inlet through which water from a water source passes to flush the cooling system; and a spent coolant outlet for the removal of water and dirty coolant from the coolant system to an external waste disposal container.

Preferably, a first outlet tube is connected to the spent coolant outlet and leads into the waste container. Also preferably, a second outlet tube is connected to the spent coolant outlet and extends into the radiator to facilitate removal of dirty, rusty water from the bottom of the radiator.

It is also preferred that the inlet has a means to increase the pressure of the water that enters through the fresh water inlet. Preferably, a first inlet tube is employed to carry water from a water source to the fresh water inlet. Also preferably, a second inlet tube is connected to the fresh water inlet and extends down into the radiator to direct the flow of fresh water to the bottom of the radiator to create turbulence. The flush cap of the present invention should not be employed in both the second outlet tube and the second inlet tube at the same time.

As is evident to those of skill in the art, the flush cap of the present invention is adapted to form water-tight seals with the first and second inlet tube and the first and second outlet tube. The flush cap of the present invention is also adapted to form a water-tight seal with the radiator inlet.

In order to drain a cooling system of a vehicle employing a cross flow radiator with the flush cap of the present invention, the second outlet tube must be employed along with a suction means for drawing fluid out of the radiator. In a cooling system employing a down flow radiator, a third outlet tube is employed. The third outlet tube is connected to a drain cock at the bottom of the radiator in a water-tight manner. The suction means is preferably employed to drain fluid out of the cooling system with a down flow radiator, also.

The apparatus and method of the present invention are characterized by the following advantages:

The flush cap of the present invention replaces the existing radiator cap without the need for installation of any auxiliary inlets into the cooling system in order to flush the system. According to the present invention there is no need to open and close the drain cocks at the bottom of the radiator and motor block or to detach and re-attach the bottom radiator hose. There is no need for an elaborate control system which must be used in order to connect together the various components of the flushing system. There is no need for a separate "priming" step which must be performed before the cooling system can be flushed and drained.

The present invention may be more fully understood by reference to the drawing figures wherein.

Figure 1:
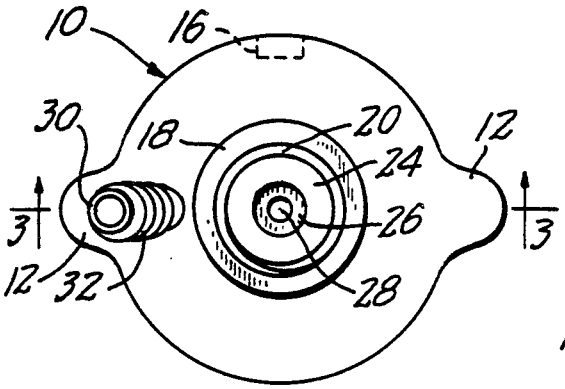
FIG. 1 illustrates a top view of a flush cap in accordance with the present invention.
Figure 3:
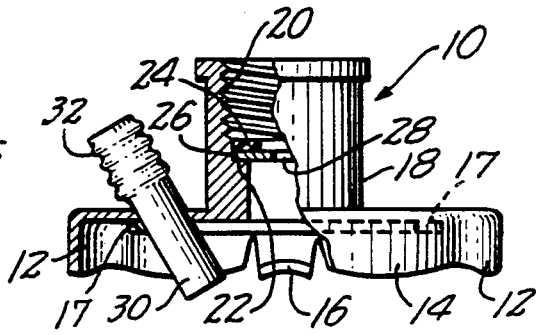
FIG. 3 illustrates a partial cross-sectional view of the flush cap of FIG. 1 taken along the line 3—3 of FIG. 1.
Figure 2:
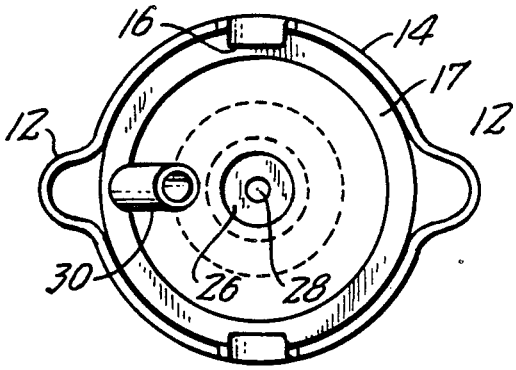
FIG. 2 illustrates a bottom view of a flush cap in accordance with the present invention.

Referring to the figures, FIGS. 1–3 show flush cap 10 having extensions 12 for rotating the cap 10. Cap 10 has a vertical side wall or flange 14 which has two tabs 16 which are adapted to move underneath complementary tabs on the outer wall of the radiator inlet pipe. Located on the under side of the horizontal wall of cap 10 is a gasket or rubber washer 17. This washer is pressed onto the top end of the radiator inlet pipe and forms a water-tight seal with the radiator inlet when the cap 10 is rotated into final operating position. The cap 10, the side walls 14, and tabs 16 are all integral.

Extending vertically upward from the cap 10 is an inlet opening 18 having internal threads and adapted to receive a source of water such as a standard garden hose. Inlet opening 18 extends above cap 10 and includes a threaded upper portion 20 having a shoulder 22. The end of a water source such as a standard garden water hose is threaded into portion 20 with the lower end of the hose bearing upon washer 24 which rests on the shoulder 22.

Figure 4:
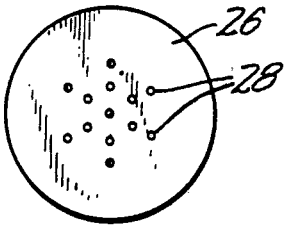
FIGS. 4 and 5 illustrate preferred embodiments of the apertured disk shown in FIG. 1.
Figure 5:
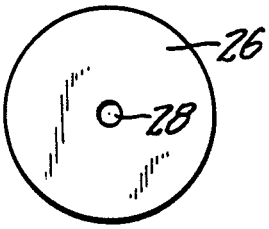

Preferably, inlet opening 18 has a disk 26 therein. Disk 26 is adapted so that water is passed under pressure into the radiator through inlet opening 18. Disk 26 is adapted to decrease the surface area of flow of the water and therefore increase the rate of flow. Suitable adaptations to disk 26 include a decrease in size of the aperture for transmission of water therethrough, or use of a plurality of smaller apertures instead of one larger aperture. Different variations of the apertures of disk 26 are shown in FIGS. 4 and 5. FIG. 4 shows disk 26 having aperture 28 which is smaller in surface area than the end of the garden hose. FIG. 5 shows disk 26 having a plurality of smaller apertures 28, the total surface area of apertures 28 being less than the surface area of the end of the garden hose. It is preferred that the total surface area of apertures 28 be less than about 75% of the surface area of disk 26. It is more preferred that the surface area of apertures 28 be less than about 60% of the surface area of disk 26, and it is most preferred that the surface area of apertures 28 be less than about 50% of the surface area of disk 26. Good results have been found where the apertures measure about ⅛ inch to about 3/16 inch in diameter. It will be evident to one of skill in the art that both the temperature and volume of water that enters the radiator must be such that the temperature of the coolant is hot enough to maintain the thermostat in an open position during flushing.

As shown in FIGS. 1–3, cap 10 also has an outlet opening 30 which is preferably ribbed with ribs 32 for better securing of a first outlet tube to outlet opening 30. However, outlet opening 30 may be smooth and the first outlet tube held manually or clamped into place during operation. Additionally, as shown in FIG. 3, outlet opening 30 extends downward below sidewall 14 so that a second outlet tube leading into the radiator can be attached.

Figure 6:
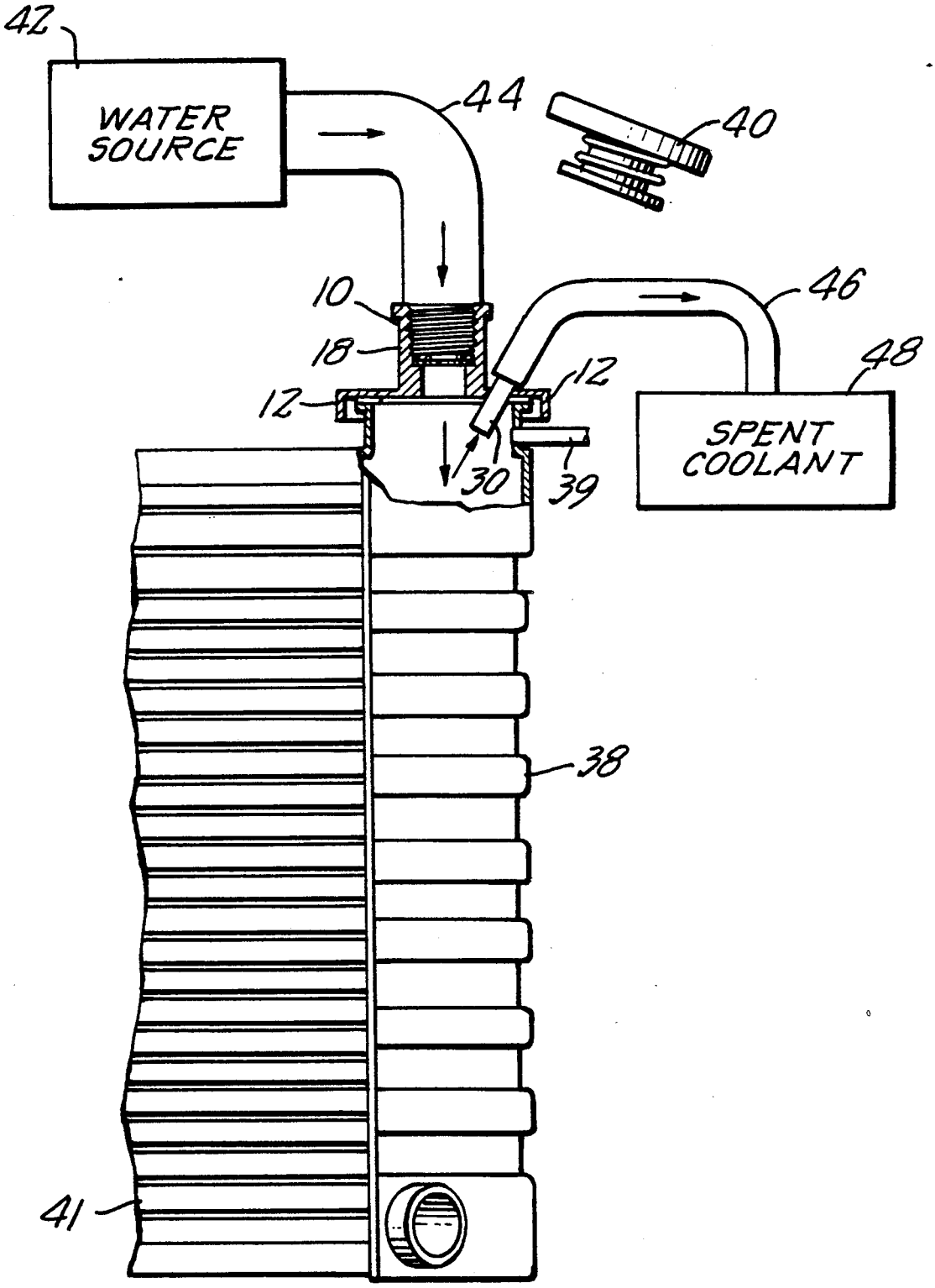
FIG. 6 illustrates the flush cap of FIGS. 1–3 attached to a radiator.

As shown in FIG. 6, radiator 38 having overflow 39 is flushed in accordance with the present invention by replacing the existing radiator cap 40 of the vehicle with flush cap 10 of the present invention. Radiator 38 has core 41 therein. A source of water 42 is connected by means of first inlet tube 44 to the inlet opening 18. A suitable first inlet tube 44 is a conventional garden hose and a suitable water source 42 is a conventional water faucet. First outlet tube 46 is connected to outlet 30 and leads to spent coolant container 48.

Figure 7:
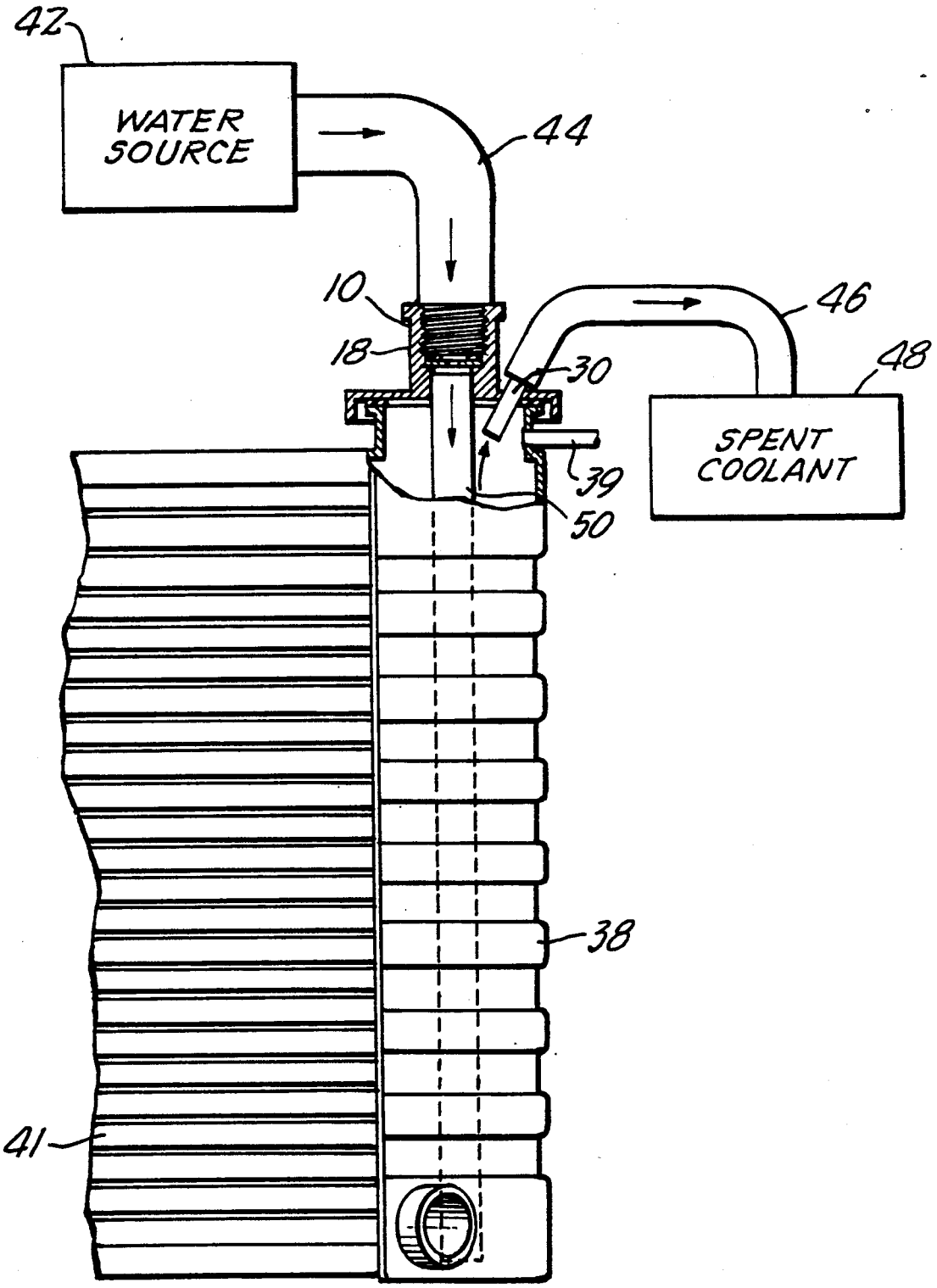
FIG. 7 illustrates a preferred flush cap in accordance with the present invention having a first and second inlet tube and a first outlet tube.

FIG. 7 illustrates cap 10 wherein second inlet tube 50 is connected to the other end of inlet opening 18. Preferably, second inlet tube 50 extends down into radiator 38 to just above the bottom of radiator 38. Preferably, tube 50 extends to within about 1 inch from the bottom of radiator 38.

Figure 8:
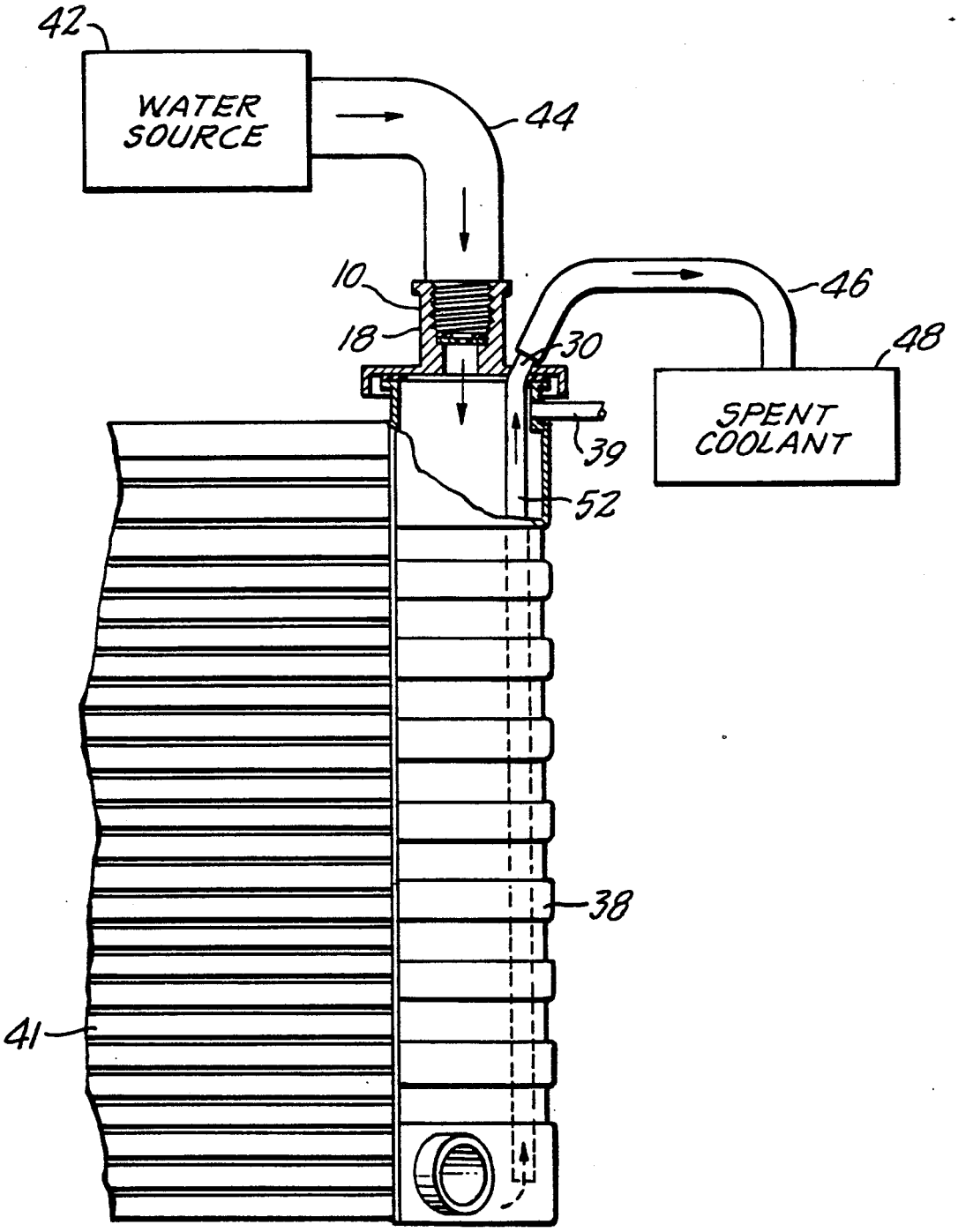
FIG. 8 illustrates a preferred flush cap in accordance with the present invention having a first and second outlet tube and a first inlet tube.

FIG. 8 illustrates another preferred embodiment of the present invention wherein second outlet tube 52 is connected to outlet 30.

In order to flush a vehicle's cooling system in accordance with the present invention, one of the flush cap arrangements shown in FIGS. 6–8 is attached to radiator 38; however, water source 42 is not turned on. Rather, the engine of the vehicle is turned on. The engine remains on during the flushing operation. The engine must generate enough heat so that the thermostat (valve) in the cooling system is opened.

Existing overflow opening 39 of radiator 38 should not be closed off during the flushing or draining operations.

After the engine is hot enough so that the thermostat is opened, water source 42 is turned on. Water is passed through inlet opening 18 and into radiator 38.

The water pressure from water source 42 is increased when passing through aperture 28 of disk 26. The pressurized water dislodges debris and sediment from the bottom of the radiator and there is enough agitation of the fluid in the radiator so that the sediment mixes with the fluid and is able to be discharged from the cooling system.

As water enters the radiator, there is pressure on the fluid (water and dirty coolant) in the radiator and the fluid flows out of the radiator through outlet 30, through first outlet tube 46 and into a waste container 48.

Fresh water from water source 42 is passed into radiator 38 until the dirty coolant is removed by continual dilution and circulating clean water throughout the cooling system of the vehicle until only clean water remains in the cooling system. It is preferred that first outlet tube 46 be clear so that visual inspection of the fluid discharged will indicate when only clean water remains in the system.

Figure 9:
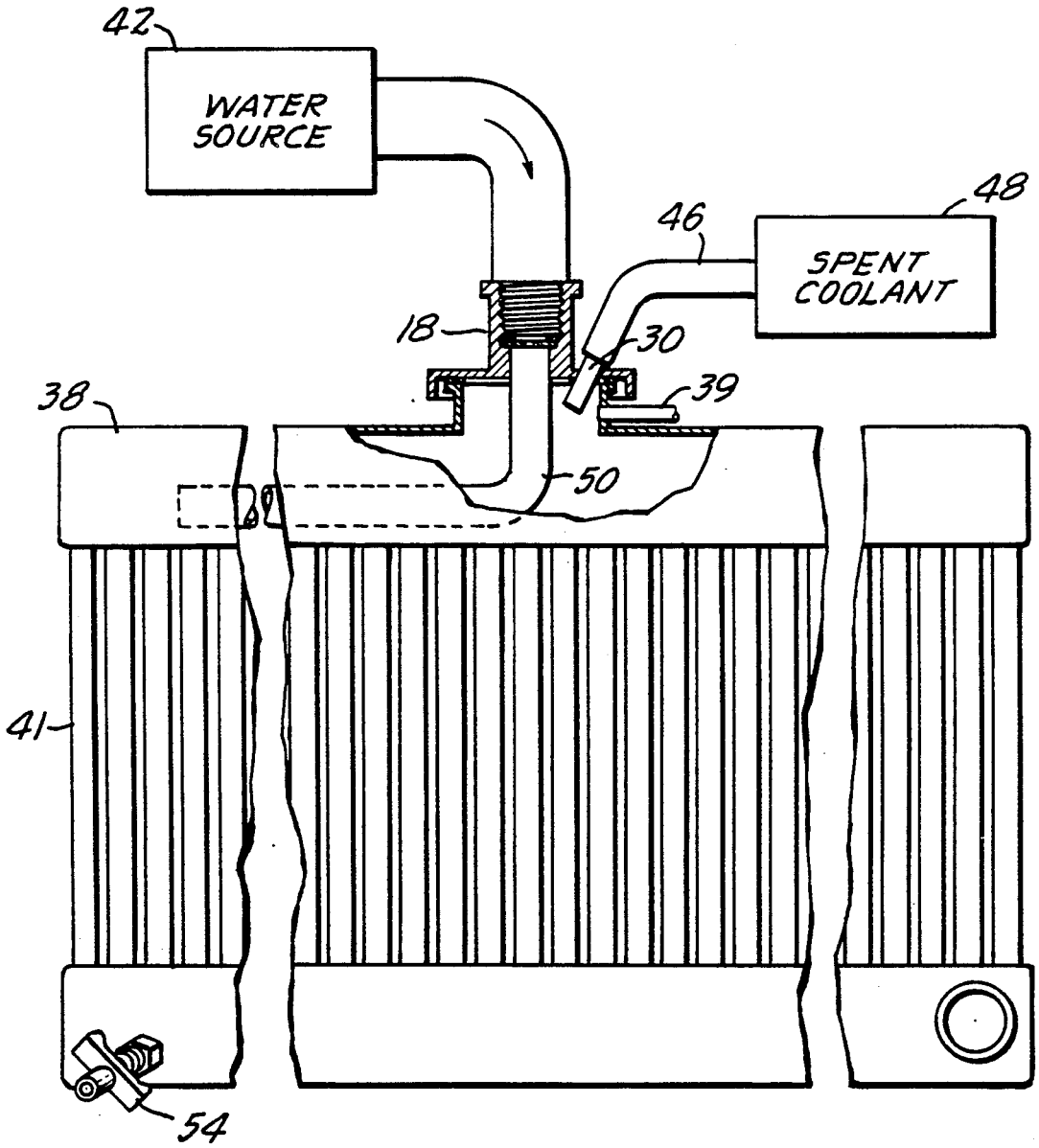
FIG. 9 illustrates the preferred flush cap of FIG. 7 in a down flow radiator.

It will be appreciated by those of skill in the art that the flush cap arrangement of the present invention depicted in FIGS. 7 and 8 is only possible in a cross flow radiator, where there is a gap along the side between the core of the radiator and outside shell of the radiator, as shown. The flush cap arrangement in FIG. 6 is possible in both down flow and cross flow radiators. In down flow radiators, the radiator core extends out to the sides of the radiator shell, but there is a space between the radiator shell and the radiator core at both the top and the bottom of the radiator. FIG. 9 illustrates the flush cap arrangement of FIG. 7 wherein second inlet tube 50 is employed. As can be seen, tube 50 runs across the top of radiator core 41. Radiator 38 has pet cock or drain plug 54 therein. The steps employed for flushing a down flow and cross flow are the same.

Figure 10:
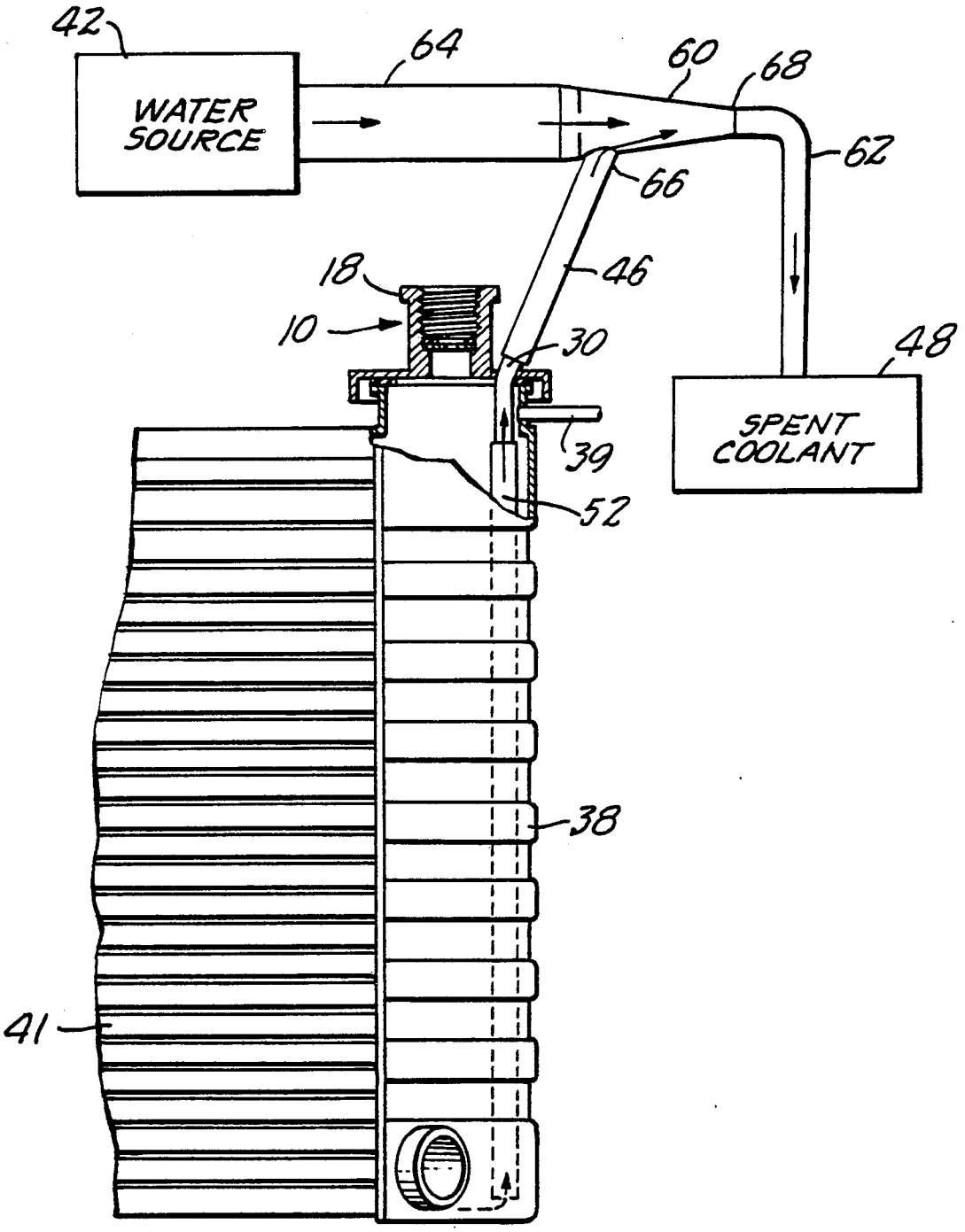
FIG. 10 illustrates an apparatus for draining a radiator in accordance with the present invention.

Now, the apparatus and method of the present invention will be illustrated for draining the cooling system so that new coolant can be added. In a cooling system employing a cross flow radiator, it is preferred to use a vacuum aspirator which attaches to the outlet opening 30, as shown in FIG. 10. Vacuum aspirator 60 is connected to outlet opening 30 and/or first outlet tube 46 in a water-tight and air-tight manner. Aspirator 60 is connected by hose 62 to spent coolant container 48. Vacuum aspirators are conventional. In order to drain the cooling system having a cross flow radiator, the flush cap arrangement of FIG. 8 must be used so that second outlet tube 52 can draw fluid from radiator 38, as shown. Water is passed through vacuum aspirator 60 from water source 42 using hose 64. As the water passes through the vacuum aspirator, negative pressure is developed at aspirator inlet port 66 such that water from radiator 38 is drawn up through tube 52, outlet 30, tube 46 and inlet port 66, into vacuum aspirator 60. Hose 62 is suitably attached to aspirator outlet 68 and leads to waste container 48.

Figure 11:
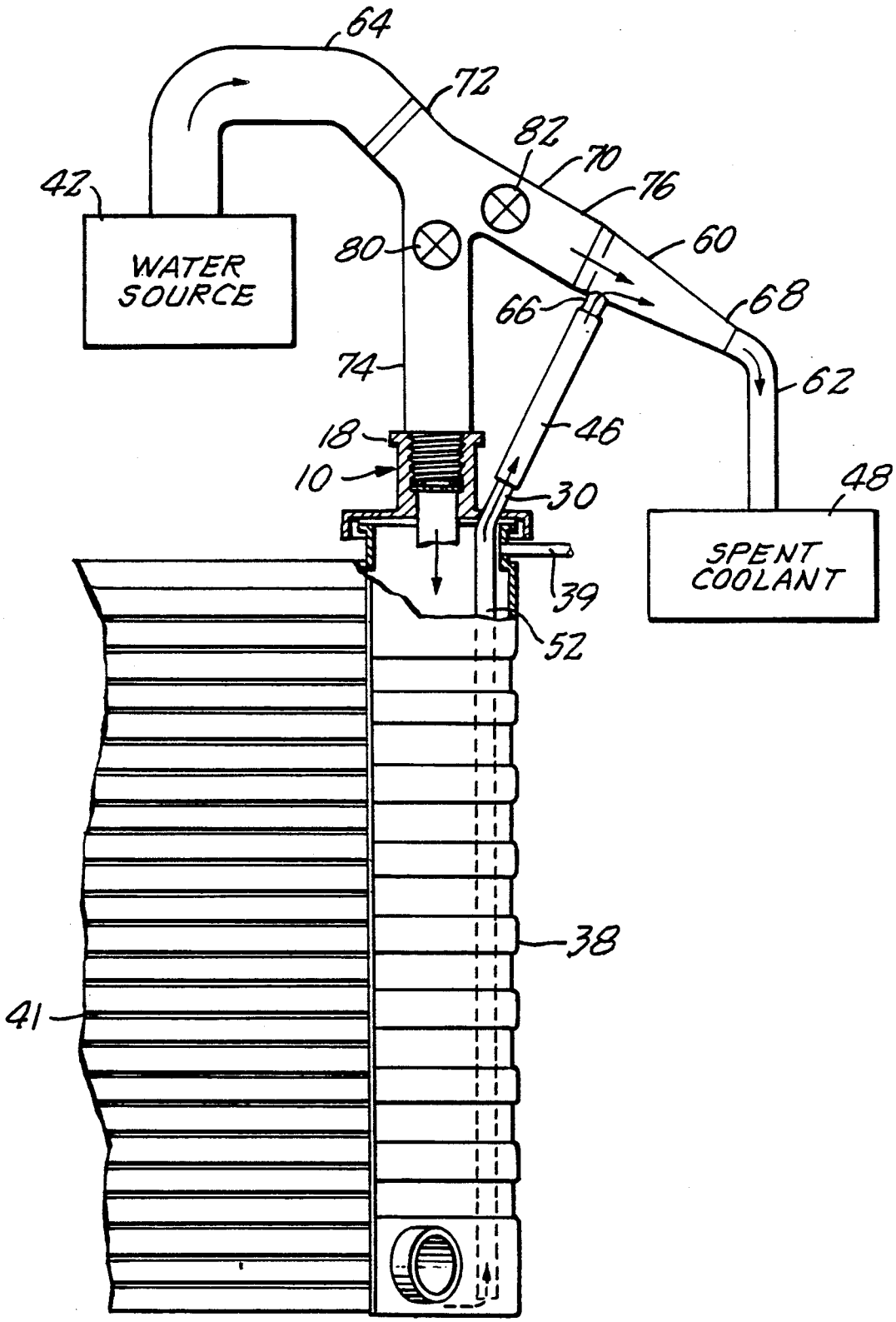
FIG. 11 illustrates an apparatus for both flushing and draining a radiator in accordance with the present invention.

Employing the aspirator of FIG. 10 and a conventional "Y" connector, the need to disconnect the water source from the flush cap of the present invention is avoided. FIG. 11 illustrates flush cap 10 wherein "Y" connector 70 is connected to fresh water inlet 18. "Y" connector 70 comprises inlet 72 and first outlet 74 and second outlet 76. First valve 80 and second valve 82 control the flow of fluid through their respective outlets. Such "Y" connectors are conventional. As is evident to one of skill in the art, to flush a cooling system using the arrangement of FIG. 11, valve 80 is opened and valve 82 is closed. Water from water source flows through hose 64 and cap 10 into radiator 38. Spent coolant exits through hose 52, outlet 30, hose 46, inlet 66, aspirator 60, outlet 68, and hose 62 into spent coolant container 48. In order to drain a cooling system having cross flow radiator 38, valve 80 is turned off and valve 82 opened so water now travels from water source 42, through hose 64, inlet 72, outlet 76, aspirator 60, hose 62 and into spent coolant container 48.

Figure 12:
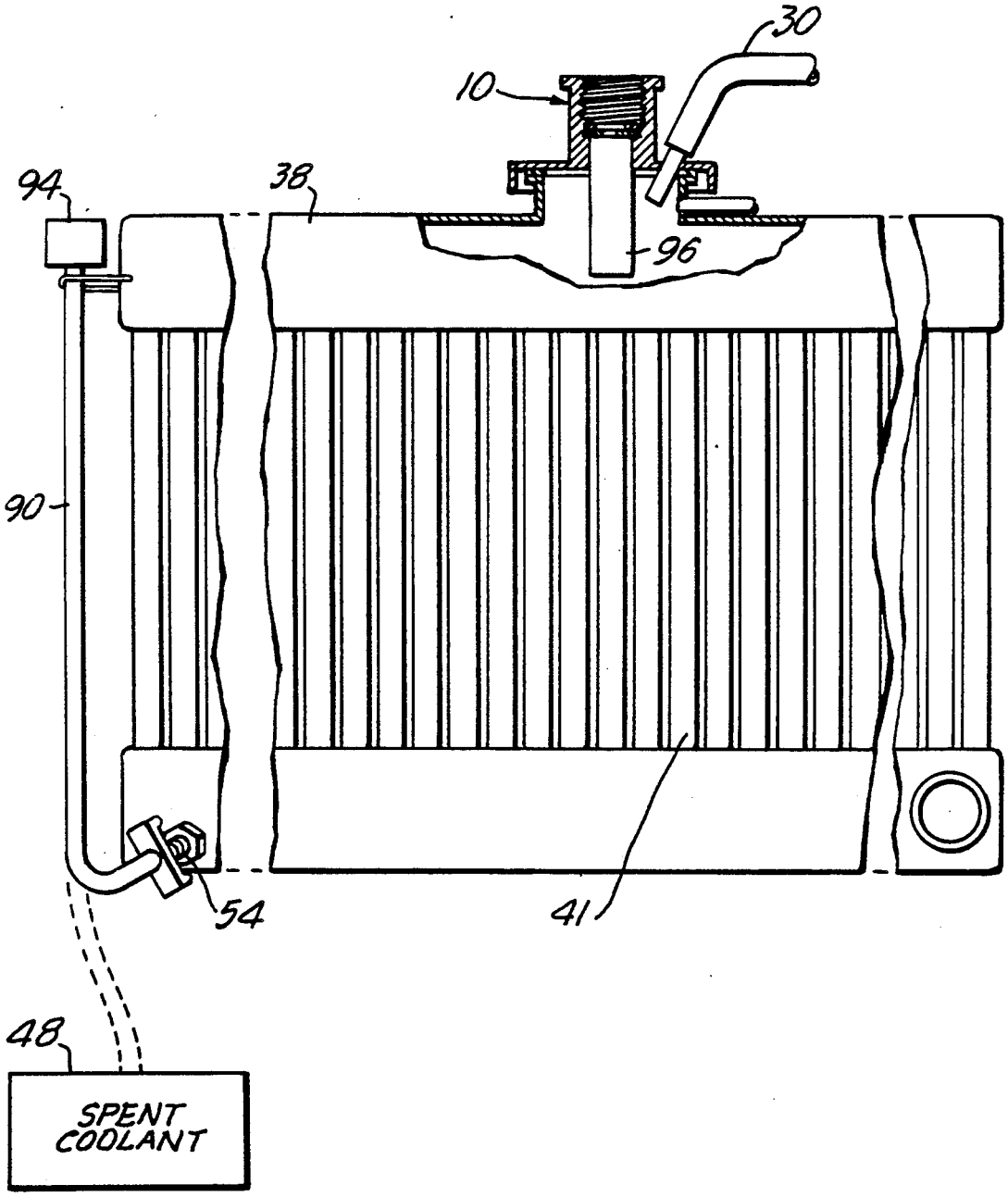
FIG. 12 illustrates another apparatus for both flushing and draining a radiator in accordance with the present invention.

FIG. 12 illustrates a preferred means for draining a cooling system employing down flow radiator 38. Hose 90 is connected to drain cock 54 at the bottom of radiator 38. Cap 94 is removed from hose 90 and hose 90 is connected to spent coolant container 48 as shown in the dotted line version. When radiator 38 of FIG. 12 is not being drained, hose 90 has cap 94 attached thereto. Alternatively, aspirator 60 is employed by connecting hose 90 to inlet port 66 so that the cooling system is drained. Second inlet tube 96 is depicted extending just into the radiator and being about 1 inch above core 41. Second inlet tube 96 can be used in both down flow and cross flow radiators.

Additionally, the present invention allows for easy addition of conventional radiator chemical cleaning additives such as Cooling System Cleanser No. 7 or Radiator 10 Minute Flush. The chemical may be added to the coolant system in order to remove corrosive elements and scale which is not suspended in the coolant fluid. The chemical additive can be added to the system, circulated through the system, and flushed from the system using the present invention.

Figure 13:
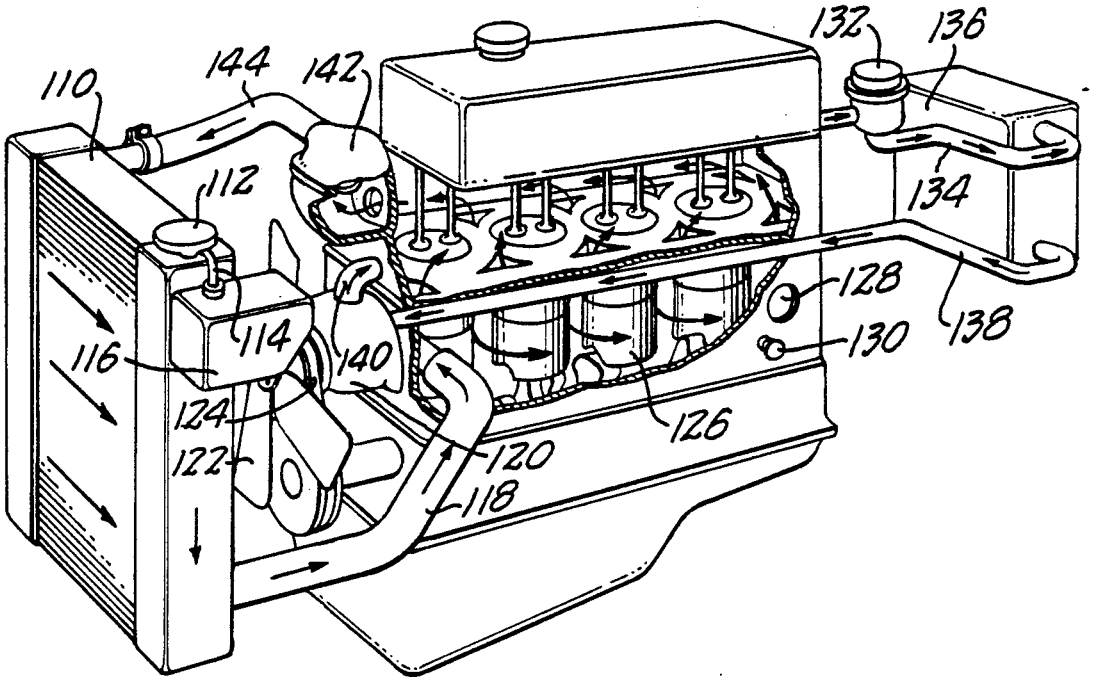
FIG. 13 illustrates a conventional cooling system of a vehicle with a cross flow radiator.

FIG. 13 illustrates a conventional cooling system in a vehicle, specifically a car. The arrows indicate the flow of coolant through the system. Radiator 110 has pressure cap 112 and, as depicted, is a cross flow radiator. Overflow tube 114 is connected to coolant recovery tank 116. Lower hose 118 allows coolant to leave radiator 110 and travel to water pump 120. Fan 122 is rotated by engine V-belt 124. The coolant is pumped by water pump 120 into the engine and around cylinder blocks and head 126. Core plug 128 and drain plug 130 of the engine are shown. Some coolant from the engine travels through heater control valve 132, heater supply hose 134 to heater 136. The coolant then leaves heater 136 through heater return hose 138 to water pump 120. Bypass hose 140 is also shown. Coolant travels from the engine into thermostat 142 and is carried by upper hose 144 to radiator 110.

Figure 14:
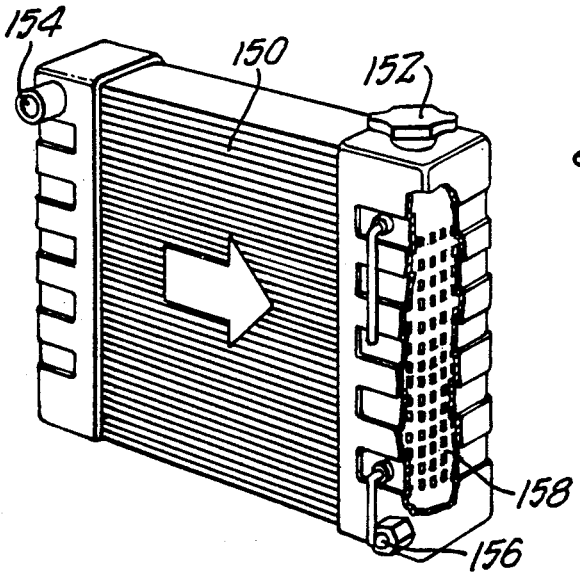
FIG. 14 illustrates a conventional cross flow radiator.

FIG. 14 illustrates a conventional cross flow radiator with core 150 and cap 152. Coolant inlet 154 and outlet 156 are shown. Transmission cooler 158 is also shown inside the radiator.

Figure 15:
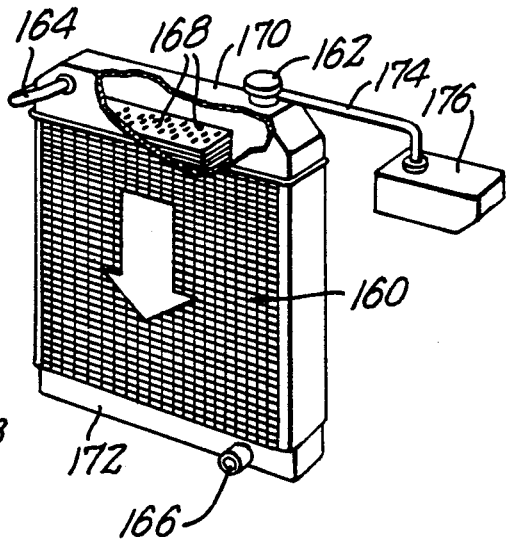
FIG. 15 illustrates a conventional down flow radiator.

FIG. 15 illustrates a conventional down flow radiator having core 160 and cap 162. Coolant inlet 164 and outlet 166 are shown. As with a cross flow radiator, water tubes 168 allow coolant to pass from coolant inlet to coolant outlet through the radiator core. Also, as with the cross flow radiator there is inlet tank 170 and outlet tank 172. In a down flow radiator, inlet tank 170 is conventionally referred to as top expansion tank and the outlet tank is referred to as the bottom tank. Also, as with a cross flow radiator, overflow 174 is connected to recovery tank 176 and operates in a conventional manner.

Figure 16:
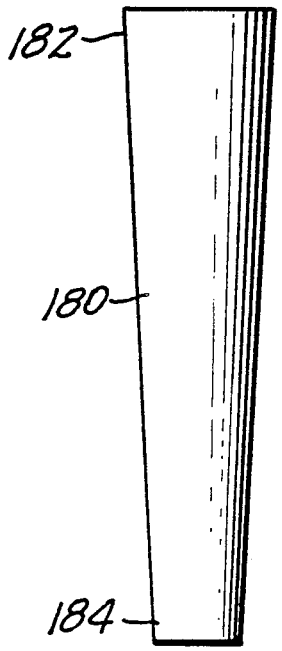
FIGS. 16–18 illustrate second inlet tubes having restricted ends.

FIG. 16 illustrates a preferred embodiment of second inlet tube for use in the present invention. As shown in FIG. 16, second inlet tube 180 is attached at end 182 to cap 10 and tapers down to end 184. Preferably, the amount of tapering is such that the inside diameter at end 182 is two or more times larger than the inside diameter at end 184.

Figure 17:
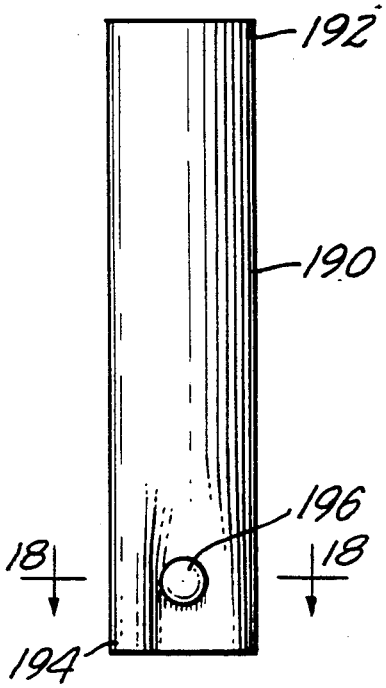

An alternative to the tapered design in FIG. 16 is to use a rivet in the end of second inlet tube as shown in FIG. 17. Second inlet tube 190 attaches to cap 10 at end 192 while end 194 with rivet 196 therein extends down into the radiator.

Figure 18:
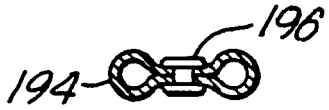

FIG. 18 shows a cross section of end 194 taken along line 18.

The embodiments in FIGS. 16 and 17 are preferred for use in a cross flow radiator. It has been found that the restricted ends help to increase the pressure of the water exiting the tube and stir up the coolant and promote the efficiency of the flushing. The tapered tube of FIG. 16 also aids in insertion of the tube into the radiator.

Figure 19:
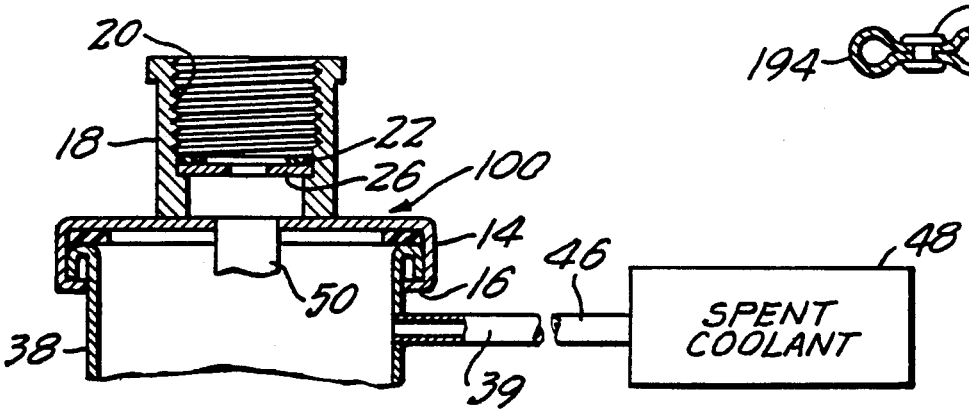
FIG. 19 illustrates an apparatus which can be employed in the method of the present invention.

It is clear that certain modifications may be made to the apparatus and method of the present invention without departing from the invention. For example, FIG. 19 shows an alternative embodiment of the flush cap which can be used in the method of the present invention. Cap 100 does not have an outlet opening therein. Instead, the existing radiator overflow 39 of radiator 38 is used when flushing and draining coolant from the system. Employing cap 100 allows the method of the present invention to be employed without using the flush cap of the present invention. In this embodiment, the method of the present invention is employed; however, radiator overflow 39 acts as an outlet for the spent coolant. Overflow 39 is not disconnected from the coolant recovery tank (not shown), rather the overflow of the recovery tank is connected by means of first outlet tube 46 to spent coolant container 48 as shown. Alternatively, overflow 39 is connected directly to spent coolant container 48 by first outlet tube 46. In this way, using flush cap 100 a cooling system of a vehicle is flushed.

It will also be evident to use overflow 39 with second outlet tube 52, alone or in conjunction with aspirator 60 and/or "Y" connector 70 in a cross flow radiator. Frêsh water inlet 18 of cap 10 functions in the same way as cap 10 except for the absence of spent coolant outlet 30.

It will also be evident to one of skill in the art that an aspirator can be connected to inlet 18 after flushing so that the second inlet tube can be used to drain the cooling system in a cross flow radiator.

If the water pressure applied into the radiator is sufficient, no inlet tube is needed to transmit water into the radiator. In the same vein, disk 26 in inlet opening 18 need not have a smaller aperture than that of the water source so long as the water pressure is sufficient to stir up debris and dirt in the radiator. However, for finer control of the flushing of the radiator, and for conservation of water with its concomitant decrease in disposal of waste water and dirty coolant, it is preferred to use the apertured disk or the second inlet tube of FIGS. 16–18 in order to increase the efficiency of the flushing of the radiator.

As is evident to one of skill in the art, all inlets and outlets of cap 10 and 100 can be threaded to take a conventional garden hose, either male or female ends, or can simply be ribbed like outlet 30 in FIG. 1, i.e. extension 32. Preferably, inlet 18 is threaded to take a conventional garden hose for fresh water. The inlet 18 of cap 10, 100 can be either fixed such that the cap is first screwed onto the end of a garden hose and then the cap placed on the radiator outlet or it swivels to facilitate affixing the male end of a threaded hose when cap 10, 100 is affixed to the radiator.

As is also evident, virtually any length hose can be employed for first inlet and first outlet tube. This allows a car owner or mechanic to flush and/or drain his cooling system without the need for both a water source and spent coolant container to be in the immediate vicinity.

It has been found that by using the flush cap arrangement of FIG. 7, a standard car's cooling system is flushed in about 4 to 5 minutes.

If the coolant system is very dirty, it is advisable to first drain the radiator and then flush the radiator followed by a second draining to allow for the addition of coolant.

No matter which method of the present invention is employed for draining the coolant system, the engine must have been run first so that the thermostat is open. The engine should also be running during the draining step itself. It is also preferred that the coolant recovery tank be drained during the draining process.

It is also evident to one of skill in the art that a conventional pump or siphon can be used in place of the aspirator for draining the coolant system.

The second inlet tube is preferably about 18 inches long.

It will also be appreciated by those of skill in the art that both first and second inlet tubes or both first and second outlet tubes can be combined into one tube rather than two separate tubes.

It will be understood that the claims are intended to cover all changes and modifications of the preferred embodiments of the invention herein chosen for the purpose of illustration which do not constitute a departure from the spirit and scope of the invention.

What is claimed is:

1. A flush cap for use in flushing coolant from the coolant system of a vehicle having a radiator, the radiator having a radiator cap closing a radiator cap opening, comprising:

(a) said flush cap adapted to replace the radiator cap of the vehicle, said flush cap having an inlet opening and an outlet opening, said inlet opening being separate and distinct from said outlet opening such that during flushing, water passes through said inlet opening and spent coolant passes through said outlet opening simultaneously;

(b) said inlet opening being adapted to receive a flow of water from a source of water; and (c) said outlet opening adapted to transmit spent coolant from the inside of the radiator to be external spent coolant container.

2. The flush cap of claim 1 further comprising a first inlet tube connected at one end to said inlet opening and at the other end to a source of water such that said tube carries water from said water source to said inlet opening.

3. The flush cap of claim 1 further comprising a second inlet tube, said second inlet tube connected at one end to said inlet opening and the other end extending into the radiator to within about 1 inch from the bottom of the radiator.

4. The flush cap of claim 3 wherein said cap is intended for use in a down flow radiator and said second inlet tube extends into the radiator opposite the side of the radiator where coolant enters the radiator from the cooling system.

5. The flush cap of claim 1 further comprising a second inlet tube which extends into the radiator.

6. The flush cap of claim 1 further comprising a first outlet tube connected at one end to said outlet opening and at the other end to said spent coolant container.

7. The flush cap of claim 6 further comprising a second outlet tube, said second outlet tube connected at one end to said outlet opening and the other end extending down into said radiator.

* * * * *